US012104886B1

(12) United States Patent
Grassi

(10) Patent No.: US 12,104,886 B1
(45) Date of Patent: Oct. 1, 2024

(54) HIGH-FRAGMENTING FLASHBANG GRENADE CHARGE HOLDER

(71) Applicant: Michael Grassi, Columbus, OH (US)

(72) Inventor: Michael Grassi, Columbus, OH (US)

( * ) Notice: Subject to any disclaimer, the term of this patent is extended or adjusted under 35 U.S.C. 154(b) by 0 days.

(21) Appl. No.: 17/867,475

(22) Filed: Jul. 18, 2022

Related U.S. Application Data

(63) Continuation-in-part of application No. 16/542,293, filed on Aug. 15, 2019, now Pat. No. 11,391,552.

(60) Provisional application No. 62/719,395, filed on Aug. 17, 2018.

(51) Int. Cl.
*F42B 12/42* (2006.01)

(52) U.S. Cl.
CPC ..... *F42B 12/42* (2013.01)

(58) Field of Classification Search
CPC .. F42B 27/00; F42B 12/36; F42B 8/26; F42B 3/087; F42B 3/28; F42B 3/11; F42B 12/42; F42C 19/08; F42C 19/0815; F42C 19/0823; F42C 19/0826
USPC ..... 102/482, 483, 484, 485, 486, 487, 488, 102/331, 282
See application file for complete search history.

(56) References Cited

U.S. PATENT DOCUMENTS 2,061,558 A * 11/1936 Brandt ..... F42B 3/28 102/314
3,505,959 A * 4/1970 Hans ..... F42C 14/02 102/487
3,645,205 A * 2/1972 Dowling ..... F42B 3/087 102/318
3,760,729 A * 9/1973 Freeman ..... F42B 4/24 102/466
3,795,197 A * 3/1974 Levenson ..... F42B 12/50 102/368
4,010,690 A * 3/1977 Cocozella ..... F42B 39/18 102/431
4,033,264 A * 7/1977 Bolza ..... C06B 47/14 102/314
4,036,138 A * 7/1977 Chopra ..... F42B 3/00 102/284
4,078,496 A * 3/1978 Kruger ..... F42C 15/285 102/487
4,726,295 A * 2/1988 Embury, Jr. ..... F42B 12/70 102/482
4,932,328 A * 6/1990 Pinkney ..... F42B 8/26 102/482
4,947,753 A * 8/1990 Nixon, III ..... F42B 8/26 102/269
5,654,523 A * 8/1997 Brunn ..... F42B 8/26 102/482
5,824,945 A * 10/1998 Barlog ..... F42B 8/26 102/482
7,412,929 B2 * 8/2008 Walsh ..... F42B 8/26 102/482

(Continued)

FOREIGN PATENT DOCUMENTS

GB 191114682 A * 4/1912
GB 1396655 A * 6/1975 ..... F42B 3/087

*Primary Examiner* — Jonathan C Weber

(57) ABSTRACT

An example charge holder includes an envelope made from a sheet material of foil formed from a metal or a metal alloy, the envelope defining an interior volume to receive therein a charge having a charge volume less than or equal to the interior volume, wherein a ratio of a charge volume of the interior volume to an envelope material volume is 5.0 or greater.

20 Claims, 7 Drawing Sheets

| Thin Wall Pressure Vessel Hoop Stress | |
|---|---|
| **Design Variables** | |
| P Pressure psi= | 14.00 |
| $D_m$ Mean Diameter (Outside Diameter (OD) - Wall Thickness (t)) inches= | 0.745 |
| t Wall Thickness inches = | 0.005 |
| **Results** | |
| $\sigma_h$ Hoop Stress psi = | 1,043,000 |

(56) References Cited

U.S. PATENT DOCUMENTS

| | | | | |
|---|---|---|---|---|
| 8,161,883 | B1 * | 4/2012 | Harasts | F42B 12/42<br>102/482 |
| 9,470,495 | B2 * | 10/2016 | Kravel | F42B 27/00 |
| 9,989,340 | B2 * | 6/2018 | Grassi | F42B 27/00 |
| 10,030,955 | B1 * | 7/2018 | Sapp | F42C 14/02 |
| 2006/0081147 | A1 * | 4/2006 | Walsh | F41H 9/10<br>102/368 |
| 2006/0096485 | A1 * | 5/2006 | Stark | F42C 19/0826<br>102/431 |
| 2010/0224092 | A1 * | 9/2010 | Kapeles | F42B 12/36<br>102/487 |
| 2017/0102219 | A1 * | 4/2017 | Grassi | F42B 27/00 |

* cited by examiner

| Thin Wall Pressure Vessel Hoop Stress | |
|---|---|
| **Design Variables** | |
| P Pressure psi= | 14.00 |
| $D_m$ Mean Diameter (Outside Diameter (OD) - Wall Thickness (t)) inches= | 0.745 |
| t Wall Thickness inches = | 0.005 |
| **Results** | |
| $\sigma_\theta$ Hoop Stress psi = | 1,043.000 |

HIGH-FRAGMENTING FLASHBANG GRENADE CHARGE HOLDER

CROSS-REFERENCE

This application claims priority to, and is a continuation-in-part of, U.S. patent application Ser. No. 16/542,293, which was filed on Aug. 15, 2019, and claims priority to U.S. Provisional Patent Application Ser. No. 62/719,395, which was filed on Aug. 17, 2018, the contents of each of which are incorporated herein by reference in their entirety.

BACKGROUND

In the art of flashbang grenades, the cartridge consists of a charge holder that holds the pyrotechnic mixture. The requirement of the charge holder is that it should be both strong enough to assure the combustible mixture's integrity during handling and carrying of the grenade. In some applications, the charge holder should also be waterproof. The charge holder should be able to withstand drops, vibration, humidity, temperature and the like. The typical charge holder is made from either cardboard or plastic. Charge holders made from such materials can occasionally create a performance issue during explosion of the flash bang grenade. During explosion, the charge holder fragments into large pieces. Since these fragments are not consumed by the pyrotechnic charge, depending on the size of the fragments, the fragments can block the grenade discharge vents. This negatively impacts the desired characteristics of a flashbang grenade, in light output, noise, and unwanted movement due to grenade ports being blocked. In the situation where a large charge holder fragment does not block the vent, it is discharged at high velocity from the flash bang grenade creating a potential hazard to the surroundings. The flash bang grenade is only designed to emit both loud noise and light, and not to emit high velocity projectiles with any harmful energy.

A charge holder described in Harasts, U.S. Pat. No. 8,161,883, is multicomponent and is designed to be used in combination with a very specialized pyrotechnic formulation that consumes an inner sleeve of the charge holder. The charge holder itself is a three-piece charge holder with a portion thereof having a reaction-consumed, aluminum slip-fit sleeve fitted inside a thick and non-consumable and non-fragmenting aluminum charge holder. The aluminum sleeve is part of the pyrotechnic charge and is not the charge holder. It is important to note that the charge holder itself does not fragment as it has large vents. The sleeve is consumed in the explosion due to the particular explosive mixture used in this flash bang grenade clearing the way for the explosive mixture to leave the charge holder through the vent holes in the charge holder itself before the explosive mixture passes through the grenade vent holes. The vent holes in the charge holder's main body resolves the fragmentation issue by itself not holding back the charge, and thus the charge holder does not fragment nor does the portion of the sleeve supported by the charge holder's main body (which shields the sleeve from high pressure). The charge holder of the '883 patent functions to filter large fragments. The arrangement if needing to be waterproofed further requires yet another external 'container' to waterproof the cartridge (charge holder and explosive mixture) that must also be consumed. In the same manner as the internal sleeve is supported by the main body of the charge holder, the external sleeve only sees 'vent windows' of pressure as well (outer sleeve is shielded from high differential explosive pressure as well as temperature). This significantly reduces the fragments of the external water proofing sleeve if they were not consumed. The disadvantages with this charge holder design, other than requiring a very special pyrotechnic formulation to consume the sleeve, requires a non-consumable charge holder main body having vent holes, and requires sealing to make waterproof which adds manufacturing complexity.

BRIEF DESCRIPTION OF THE DRAWINGS

The invention may take physical form in many shapes, the embodiments of which will be described in detail in this specification and illustrated in the accompanying drawings which form a part hereof and wherein.

DETAILED DESCRIPTION

In accord with aspects of the present concepts disclosed herein, there is provided a charge holder construct that is waterproof, simple to manufacture, and does not need to be consumed by a special pyrotechnic formulation.

In order for flashbang grenades to be commercially viable, the charge holder needs to be simple and low cost. During manufacturing, the charge holder is typically first filled with a premixed explosive mixture and then this assembly (the cartridge comprising the charge holder and the explosive mixture) is mounted to the grenade body. Mounting of the cartridge to the grenade body is typically performed by gluing, a tedious process in which the glue must bond to both the charge holder body (plastic or cardboard) and grenade body (metal) with the charge holder containing the explosive mixture. In some examples of the present concepts (see, e.g., FIG. 5) an improved charge holder design is provided that eliminates the need for gluing and instead provides for fastening of the charge holder to the associated grenade body without the need for gluing.

Another desired object of this invention is to permit mixing of the explosive component in situ. This permits a safer environment for manufacturing.

It is an object of the invention to eliminate charge holder fragments from becoming high velocity projectiles during explosion of the flashbang grenade, but also not to block the grenade vent holes. One advantage of using cardboard and plastic is that these materials have low thermal conductivity. When fragments from these materials are expelled during explosion, it is very unlikely a fragment carries enough thermal energy to cause a fire to the surroundings. It is an object of this invention that any fragment being discharged from a flashbang grenade has low thermal energy.

Disclosed herein are example charge holders that (1) are low cost, (2) are not consumed by the pyrotechnic formula when the flashbang grenade explodes, (3) do not cause any of the charge holder itself to act as a projectile, (4) do not increase the chances of a fire, (5) do not block the flashbang grenade vents so as to improve the grenade light and sound characteristics, (6) can be assembled using a fastener on the charge holder, (7) permits in situ mixing of the pyrotechnic ingredients, and/or (8) is strong enough to undergo drop tests without breaking apart.

Figure 3:
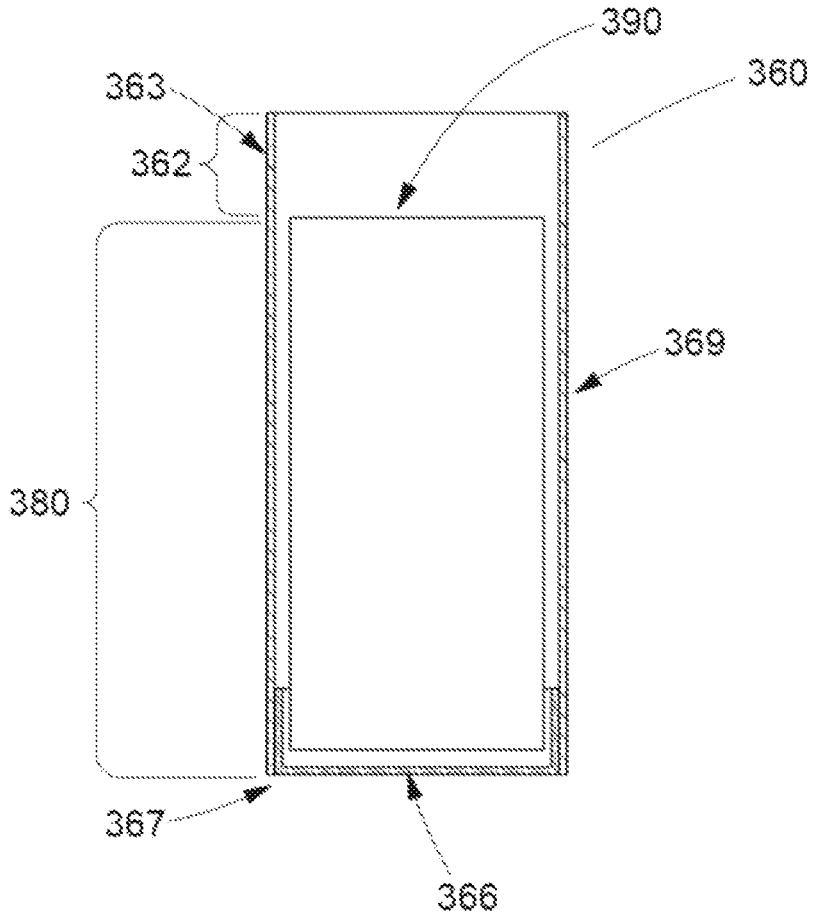
FIG. 3 is a side sectional view of an example second embodiment of a cylindrical charge holder, an example two piece construct, in accord with the present concepts.

The above-noted objects and functions are met by the disclosed charge holder, the disclosed cartridge, and/or the disclosed grenade body incorporating such cartridge. In some examples, the charge holder comprises, or is formed from, a thin, flexible material (a sheet material) such as, but not limited to, a metal-plastic laminate, a "foil" or "metal foil" (e.g., a thin metal or a thin alloy that is drawn or machined), a foil-laminate (e.g., a plurality of layers of one or more foils, with or without any intervening materials between adjacent foil layers). A presently-preferred construction is a single piece foil construction, although the present concepts encompass charge holders comprising multiple, joined pieces, an example of which is shown in FIG. 3, where a "bottom" piece is first made, and second "main body" piece is made, and these two said pieces are joined together by either gluing, friction welding, crimping or other means to give a water proof and bonded joint that is equal or greater in strength that of the lesser of the individual parts that are joined.

In at least some aspects of the present concepts, the sheet material has a melting temperature lower than the explosion temperature within the grenade body, typically less than about 1300° F. In some examples, a sheet material comprising a metal foil is presently preferred, although a foil-laminate is also possible. Metals having melting temperatures less than about 1300° F. include, for example, tin, aluminum, magnesium, or metal alloys made from these metals. Foils are generally characterized by a high thermal conductivity and a low specific heat. Provided the foil is thin, the foil will heat up to a temperature when the grenade is detonated (exploded) where the material strength properties become very low, causing the foil to become extremely flexible. For this reason, aluminum is an extremely good candidate for use as a sheet material in the disclosed charge holder since it is both low in specific heat and has high thermal conductivity. Sheet material, as used herein, may include a unitary material (e.g., a single material) or a composite material (e.g., a plurality of different materials).

As noted above, the example charge holder body (envelope) comprises a sheet material. In some examples, a majority of the example charge holder body or envelope comprises a sheet material. In some examples, substantially all of the example charge holder body or envelope comprises a sheet material. The majority of the body (envelope) which is most prone to fragmentation must be extremely thin and, at elevated temperature, is extremely flexible, foldable, and/or pills. Thus, in some examples, the portions of the charge holder body or envelope which are most prone to fragmentation (e.g., surface areas not constrained or supported by other parts of the grenade body, such as the neck area) comprise a sheet material that is extremely thin (e.g., less than about 0.020") and, at elevated temperature (e.g., temperatures that occur due to chemical reactions which exceed about 800° F.), is flexible (e.g., at least generally comparable to clothing fabrics or paper stock), foldable and/or pills (e.g., "pilling" is exemplified by synthetic thread that under a heat gun or a match flame will "ball"). As determined by the present inventor, the areas of the envelope which are most prone to fragmentation are the walls and therefore this area, in particular, are thin to achieve the characteristics noted above. If the envelope shape is cylindrical or near-cylindrical in shape, as is described below in some embodiments, the stresses in the walls are readily calculated using well known pressure vessel and hoop stress models and calculations, and it can be easily verified that the walls will have the highest stresses during detonation of the pyrotechnic charge.

To eliminate large charge holder fragments, without a special pyrotechnic formula that consumes the fragment material or a filter (e.g., a vent window as in '883), the disclosed charge holder utilizes sheet material configured to fragment, ball up (pill) and/or melt in a manner that grenade function is not unduly compromised. As determined by the present inventor, the charge holder heat up rate is directly proportional to an amount of envelope material and, correspondingly, the envelope thickness matters. A thin envelope formed from or comprising a thin sheet material allows the sheet material to heat up so rapidly that it substantially instantly melts or loses material strength properties and pills (balls up). In addition, the sheet material itself can be wrapped as a multilayer (e.g., a multilayer cylindrical tube, etc.), thus optimizing higher surface area for heating when the charge holder envelope fragments. However, the preferred construction is a single layer made by machining or drawing. In another example, a multilayer envelope charge holder construct can be made by rolling. In this manner, the envelope itself can be made somewhat stronger while retaining a very fast heat up rate during the charge explosion and the holder's envelope fragmenting.

The present inventor has determined that the ratio of the charge volume (CV) of the charge holder (amount of pyrotechnic volume) to the amount of envelope material volume (MV) that makes up the charge holder can be used to characterize the charge holder's performance. The CV/MV ratio of this disclosure is greater than a CV/MV of above about 5.0. In some examples, the CV/MV ratio of this disclosure is between about 5.0-7.5. In some examples, the CV/MV ratio of this disclosure is between about 7.5-15.0. In some examples, the CV/MV ratio of this disclosure is between about 15.0-30.0. In some examples, any of the aforementioned CV/MV ratios between 5.0-30.0 are combined with a requirement that the hoop stress of the envelope is equal to or in excess of 1000 psi. In contrast, the present inventor has determined that conventional plastic or cardboard charge holders have a CV/MV of about or less than 4. The presently preferred CV/MV ratio of charge holders disclosed herein is above 7.5. In some examples, the CV/MV ratio of charge holders disclosed herein is above between 7.5 to 15. In some examples, the CV/MV ratio of charge holders disclosed herein is above between 15-30.

In some examples, the preferred envelope shape is generally cylindrical. In some examples, one end, or both ends, of the envelope shape is spherical, conical, or even rolled and pinched like a toothpaste tube. As noted herein, in some examples, the "hoop stress" of the generally cylindrical or cylindrical charge holder at room temperature is desirably greater than about 1000 psi, which allows the reaction pressure of the pyrotechnic charge to take place at higher than atmospheric pressure of about 14 psig. By characterizing the charge holder by hoop stress, the material need not be defined per se since the material properties will then define the wall thickness, as is shown by example below.

For thin-walled vessels the Young-Laplace equation for estimating the hoop stress created by an internal pressure on a thin-walled cylindrical pressure vessel is:

$$\sigma_\theta = \frac{Pr}{t} \text{ (for a cylinder)}$$

where P is the internal pressure, t is the wall thickness, r is the mean radius of the cylinder, and $\sigma_\theta$ is the hoop stress. Since the hoop stress level to be withstood is desired to be greater than 1000 psi without failure, the product of the internal pressure multiplied by the ratio of the mean radius of the envelope and the wall thickness of the envelope must be greater than or equal to 1000 psi. To meet the characteristics as described, the wall thickness of the charge holder of this disclosure is less than about 0.02" and in some examples, between about 0.0005" to 0.02". The "hoop stress" is desirably greater than about 1000 psi so that the reaction pressure of the pyrotechnic charge will take place at higher than 14 psig. Given that the charge holder of this disclosure is characterized by a nondimensional ratio (CV/MV) ("the volume of the interior volume to an envelope material volume is about 5.0 or greater") the determination of other variables of the charge holder is complete.

Figure 7:
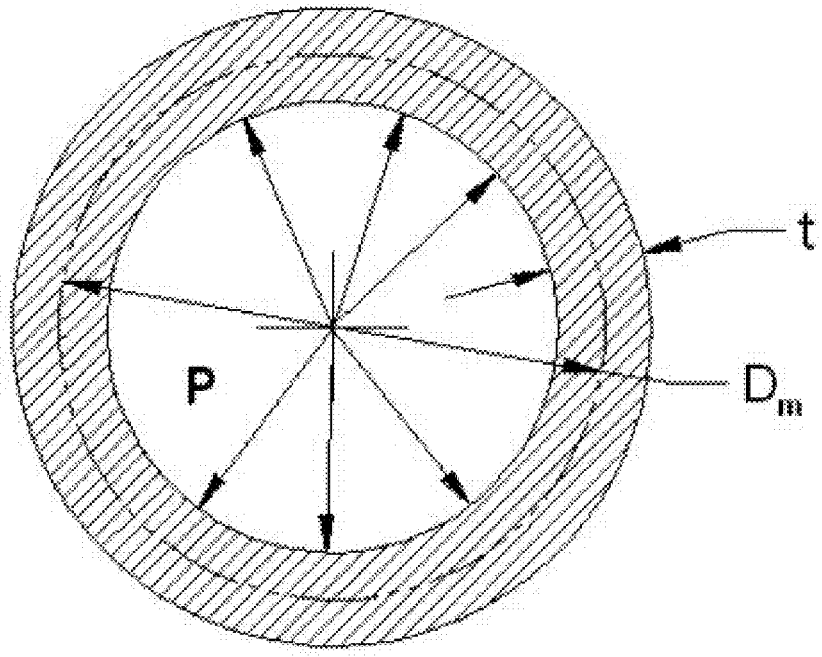
FIG. 7 illustrates an example calculation of thin wall pressure vessel hoop stress.

An example calculation is shown in FIG. 7.

In the above example calculation, a pressure of 14 psig is selected as previously described. The mean diameter and thickness are operational variables subject to the constraint that "the ratio of the volume of the interior volume to an envelope material volume is about 5.0 or greater" (i.e., CV/MV). The claimed minimum hoop stress can then be input (hoop stress>1000 psi) and one of, or both of, the mean diameter or wall thickness varied to determine appropriate values therefor. In the above example, an example Mean Diameter of 0.745 was selected, which yields a wall thickness of a little greater than 0.005 inches. The ultimate tensile strength of the material would thus need to be greater than 1043 psi and another iteration of increasing the wall thickness would lower this result to below 1000 psi for the hoop stress. One is left to define the length of the cylinder by the ratio CV/MV (using the ratio that the charge volume of the interior volume to the envelope material volume needs to be greater than 5.0).

As to material selection, it is a simple matter for a person reasonably skilled in the art to select a material having an appropriate tensile stress without undue experimentation.

It is possible using Swiss CNC lathe operations to construct the charge holder from a single piece of metal.

As noted above, in some aspects of the present concepts, it is desired (but is not a requirement of the present concepts) to eliminate a gluing operation during manufacture of the charge holder. After the charge holder is filled with explosive material and during or following attaching of the charge holder to the grenade body, some embodiments disclosed herein can be screwed to the grenade endcap, whereas other embodiments disclosed herein can be glued. For those embodiments that are screwed to the either one of the bottom, top, or both the top and bottom endcaps, this can be achieved by either forming or molding one or more ends of the charge holder into threads or another form of mechanical connector. A neck can be formed at one end of charge holder or even at both ends. Both necks can be threaded, or comprise another form of mechanical connector, or only one. The neck that is not sealed, can also include an o-ring gland for sealing the charge holder to the grenade endcap. In the case of having a thread on both ends of the charge holder or having two necks, only one of the ends needs to be manufactured open so as to receive the pyrotechnic charge materials.

In some examples, the charge holder includes an end portion with a mechanical connector, such as a threaded portion (e.g., a neck with a threaded portion) or a male/female connector. In some examples, the mechanical connector (e.g., a threaded portion) is formed on or molded onto the example neck of the example charge holder. In some examples, the neck and mechanical connector are made from the same material. In some examples, the neck and the mechanical connector are made from different materials. For instance, the example charge holder envelope is made from a first material and the end cap having a mechanical connector can be a separate piece made from a second material. In another example, the example neck and mechanical connector are made from a plastic material bonded to the charge holder body. In some examples, a different material can be used for the mechanical connector and charge holder end cap since this portion of the charge holder does not fragment as much as the envelope walls during the charge explosion.

Thus, the charge holder envelope during explosion can be made to break away from the endcap. A neck can also be formed at one end of charge holder. This is similar to the end a plastic bottle which receives a threaded cap. The neck can also include an o-ring gland for sealing the charge holder to the grenade endcap. In the case of having a thread on both ends of the charge holder, only one of the ends needs to be manufactured open so as to receive the pyrotechnic charge materials. However, a plastic end cap having a mechanical connector (e.g., threads, etc.) is advantageous since the lip of the threaded end cap is self-sealing due to the material being plastic and conformable, eliminating the need for an o-ring gland, or other type of sealant. The plastic lip conforms to the metal grenade body where joined or fastened and forms a waterproof seal from biasing the lip against the metal grenade body. In some examples, where the mechanical connector includes threads and the threads provide a redundant waterproof seal. Accordingly, a charge holder bearing the mechanical connection can thus be used with an appropriate change to the grenade body to allow the charge holder, once filled with pyrotechnic ingredients (the cartridge), whether or not premixed, to be mechanically connected into (e.g., screwed into, etc.) the grenade body without the need for a gluing operation. Here again, even if the threads are not of the sealable type, the threads form a fastener to the charge holder to the grenade body so that gluing operation is simplified by not needing to clamp while simultaneously gluing.

In some examples, both sides of an envelope formed as a cylindrical shape may include a neck, with each neck having a mechanical connector, such as a threaded neck. In other examples, one of these necks connecting to non-fuse side of grenade need not have threads or other mechanical connector. A two neck configuration permits one side of the envelope to be attached to a fuse side of the grenade body (top end wall in FIG. 1) and the opposite side (bottom end wall in FIG. 1) to support the charge holder "cylinder" portion for handling purposes so extremely thin walls need not have to support high impacts if the grenade is mishandled (or because the yield strength of the charge holder material properties are low). Appropriate changes to the grenade body itself, such as a hole in the bottom end wall for one of the two necks may have to be made for this.

As described herein, during the explosion/detonation of the grenade, the charge holder envelope, a sheet material, is quickly heated to at, or near, melting temperature due to a designed thinness of the charge holder wall thickness. This results in the majority of the charge holder envelope fragments to pill (ball up) forming micro balls having little to no mass. If the micro balls are ejected from the grenade vent holes, they have very little momentum energy being that they are very small in volume. Also, since the micro balls are so small, they instantly cool with the surrounding entrained air. The wall thickness of the cylindrical charge holder construct of this disclosure can at least be made to exceed a cardboard or plastic charge holder in strength. At the same time, since the charge holder disintegrates into very tiny parts, this prevents the grenade vents from being blocked.

As noted, in some aspects, the example charge holder envelope can be formed into shapes other than a cylinder such as, but not limited to, a spherical shape, an oblong shape, or a shape similar to that of a toothpaste container. Spherical shapes are advantageous since the surface area is minimized to the charge holder's volume, resulting in even fewer potential fragments while simultaneously increasing the charge holder envelope strength. However, an envelope in a spherical shape construct in accord with aspects of the present concepts is more expensive to manufacture and more cumbersome to handle than that of an envelope in a cylindrical form, toothpaste form, or even a tube having necks on both ends.

Yet another advantage of the example charge holder of the present disclosure is that the smaller the wall thickness, the smaller the fragments that lead to pilling that create micro balls. The charge holder in this disclosure, regardless of design, fragments upon explosion resulting in smaller sized pieces, thus lessening a chance of asymmetrically vented gases to cause the grenade to become a projectile. Another distinct advantage is the charge holder itself need not be consumed by the charge reaction, or that it requires any special pyrotechnic formulation. This is because the charge holder wall material can be heated quickly to a temperature where its material strength is significantly reduced, hence the reason for a higher CV/MV as compared to conventional grenades (it is to be noted, some of the energy from the pyrotechnic charge is used to heat up the charge holder). At elevated temperatures, metal loses at least 90% or more of the material strength properties. This permits the material to "pill."

The pilling phenomenon described above can be easily demonstrated by performing a "heating up to melting effect, " which can be observed by taking a standard propane torch and aiming a flame from a propane torch at a sheet of household aluminum foil. The sheet or foil instantly either melts or crumples from a loss of material properties, but it also instantly cools due to the high surface to volume ratio. In comparison, neither plastic nor cardboard will be observed to do this. One can also see that after the maximum tensile stress of the material is exceeded, the metal sheet (foil) is much more likely to break up into very small pieces. In addition, in a worst case event (a lower than desired level of pyrotechnic charge fill), even if the sheet (foil) does not pill into a micro ball during the explosion, the sheet (foil) at high temperature has little material strength and the hot explosive gases (even with an under charge) will easily push the charge holder fragments through a grenade vent preventing vent blockage. Thus, a piece of sheet can be made to easily pass through any grenade vent in contrast to either cardboard, plastic, or a thick piece of metal that does not heat up to the melting temperature, or has a loss of material strength as described.

Further, if a piece of the disclosed charge holder envelope were somehow to exist long enough to pass through a grenade body vent, the thermal energy and the momentum of such a piece would be negligible as the piece (particle) would cool rapidly after heating and after exposure to ambient. Thus, the particle is not able to start a fire (not enough thermal energy) nor does it have enough mass as a projectile that it can travel very far or with any harm.

As noted above, an example charge holder in accord with aspects of the present concepts can be formed into a cylindrical shape of a toothpaste tube, where the bottom of one side is made to be flattened and rolled over (crimped/bonded etc.) while the opposite end comprising a mechanical connector (e.g., a threaded end piece) that can be connected to (e.g., threaded into) a corresponding connector (e.g., a mating receiving end) of the grenade body, or glued.

To be clear, the charge holder "sheet" does not need to start off as a cylindrical piece of metal. In some examples, the charge holder sheet material starts as a slug which is then formed into a sheet or is shaped into a container having thin walls (envelope), via a conventional forming method (e.g., extrusion, drawing, pressing, etc.), following which one or more coatings may optionally be applied by a conventional application method such as spraying, dipping or the like. The charge holder of this embodiment may be advantageously be used in any flashbang grenade that currently employs a standard cardboard or plastic charge holder to thereby offer a higher level of safety and potentially increase the manufacturability aspects of same. Stated differently, the example charge holders disclosed herein can be produced as a standalone product that can be used in combination with conventional flashbang grenade designs.

The present inventor has determined that proper in-situ mixing of the pyrotechnic "charge" (ingredients) is directly correlated to the charge holder inner wall coefficients of friction. To achieve lower times of in-situ mixing in manufacturing and to achieve a well-mixed charge in a charge holder made of metal (especially aluminum metal), the inner wall of the charge holder needs to be either coated with a low coefficient material such as paint, anodized, or an additional piece of low coefficient material such as a Teflon sheet. The preference is something as simple as a sheet of paper, that even though does not pill as described, is so thin that the extra sheet is consumed during detonation; or, if not consumed, offers no contrary performance issues such as blocking the grenade endcap ports. One such example of a material that would work is copy paper made by Hammermill that is 20 lb and 75 g/m$^2$.

Figure 1:
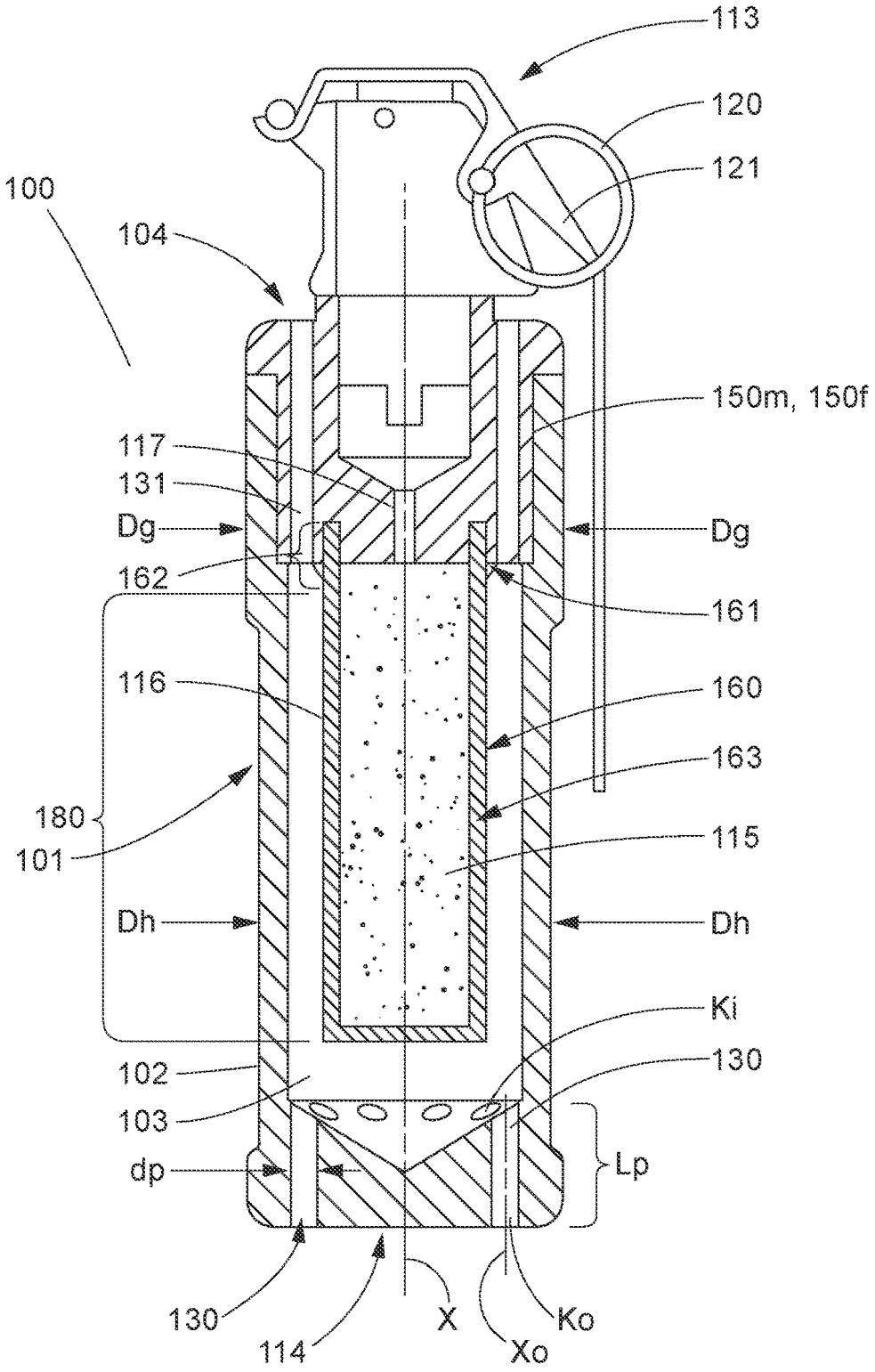
FIG. 1 is a cross sectional view of a stun grenade having a charge holder.

Referring now to FIG. 1, an example stun grenade 100 is shown according to U.S. Pat. No. 9,989,340 to Grassi et al., which is incorporated herein by reference in its entirety. It is to be emphasized that the example charge holders disclosed herein are not limited to the example stun grenade 100 depicted in FIG. 1 and can be used as a replacement to charge holders in use in other stun grenade designs, including those commonly found in the market today. In the example of FIG. 1, an example stun grenade 100 has an example housing 101 generally symmetric about a longitudinal axis X. The example grenade housing 101 is generally cylindrical and includes an example side wall 102, which can have more than one diameter (ID and/or OD) and/or vary in thickness. As shown in FIG. 1, the example housing 101 has two diameters Dg and Dh, where the respective diameters include a larger diameter for the ends of the grenade housing and a smaller diameter between the ends for a hand hold to enhance grip and to minimize a potential of slippage during use. Defined in the example housing 101 is an example cylindrical cavity 103 that is capped at the ends by a top end wall or end cap 104 and bottom end wall 114. In some examples, the top end wall or end cap 104 is fastened to the example side wall 102 by example threads 150*f* and 150*m*, where 150*f* is a female thread and 150*m* is a male thread.

The example cylindrical cavity 103, although not shown as being sealed in FIG. 1, contains an example cartridge 116 including an example explosive charge 115 being held by an example charge holder 160 (a cartridge is the combination of a charge holder and a pyrotechnic charge). In the illustrated example, the explosive charge 115 is detonated by a fuse (not shown for simplicity) when the example safety pin 120 is pulled and an example lever 121 is also pulled, which ignites a flash charge (not shown, but which resides above a flash hole 117), which may occur after a preset delay. The flash charge, in turn, ignites the fuse, with the path of ignition of the fuse traveling through the example flash hole 117 and down into the example explosive charge, wherein it ignites the explosive charge 115. When the explosive charge 115 detonates, the products of combustion and fragments from the charge holder 160 are expelled through both example bottom orifice ports or vents 130 and example top orifice ports or vents 131. In some examples, the example bottom orifice ports or vents 130 and example top orifice ports or vents 131 can each have a longitudinal axis Xo such that the several axes are oriented parallel to the housing axis X.

Example ports 130, 131 shown in FIG. 1 are where the products of combustion are expelled to atmosphere. In the example of FIG. 1, the example orifice ports 131 and 130 are not equal in diameter or in length. In some examples, the example orifice ports 131 and 130 differ in diameter and/or length and/or shape. In some examples, the example orifice ports 131 and 130 are positioned to discharge at positions other than the top end wall 104 and the bottom end wall 114. In general, it is desirable to position and dimension the example orifice ports 131 and 130 so that the momentum transfer of the explosive charge is balanced in a manner to avoid force imbalances that would unduly accelerate the grenade 100 (e.g., so that the grenade does not act as a projectile itself from the detonation). In this regard, the products of combustion and the charge holder fragments are discharged along the longitudinal axis X of the device 100, and the momentum transfer is controlled by a number of factors including, but not limited to, the entrance coefficient of orifice ports (Ki), the diameter of the ports (dp), the length of the ports (Lp), and exit coefficient of the orifice ports (Ko). If a large fragment from the charge holder 160 were permitted to cause a blockage of one or more the associated grenade 100 ports, such blockage could affect or adversely impact the performance of the grenade 100, such as its output sound pressure level (dB) or luminosity, and/or disadvantageously cause physical movement of the grenade 100 during discharge.

While FIG. 1 shows the example charge holder element 160, the example wall thickness is shown to be fairly thick as it represents an example wherein the example charge holder element 160 is made from cardboard and/or plastic. As shown, the example charge holder 160 comprises an example neck 162 for connection to the example grenade 100 and an example envelope 180 for containment of an associated volume of an example pyrotechnic charge 115. In some examples, the example envelope 180 is made from one or more layers of an example sheet material 163. As used herein, the term "sheet material" expressly includes flexible multi-ply materials (e.g., a sheet material having more than one layer of the same material, such as two layers of the same material oriented along different directions, and/or different materials) and flexible composite materials (e.g., a fiber-reinforced sheet material).

In the example of FIG. 1, an example adhesive line 161 (e.g., glue, epoxy, etc.) is depicted and represents one possible example of attachment, such as via a manufacturing process, between the example neck 162 of the example charge holder 160 and the example grenade 100 (e.g., the example end cap 104, etc.). As previously stated, the example charge holder 160 can be utilized in combination with conventional grenades.

Figure 2:
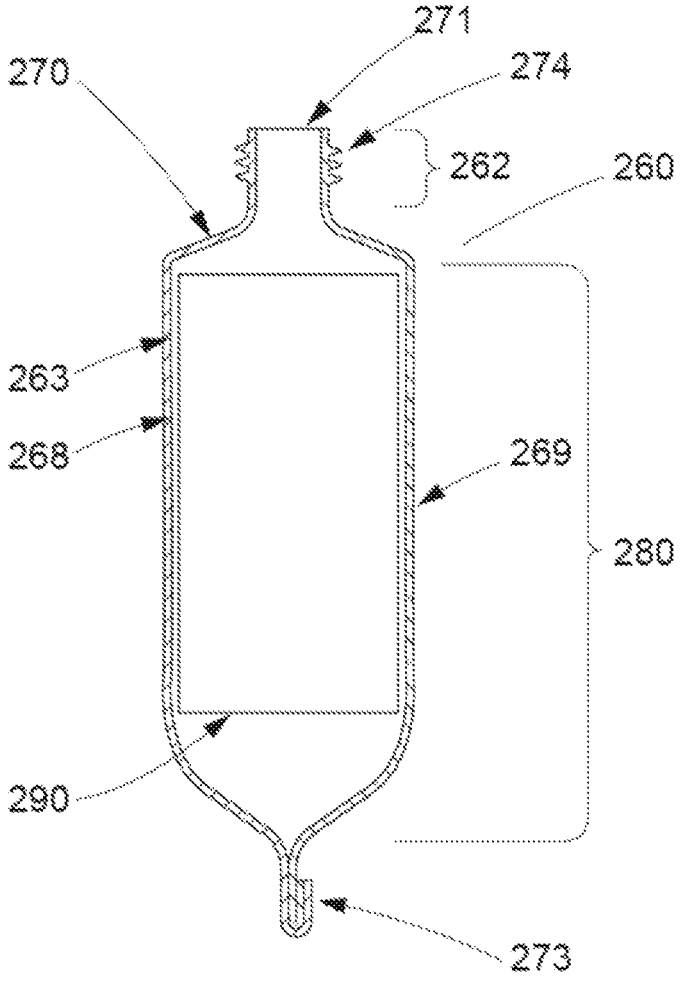
FIG. 2 is side view of a cylindrical charge holder in the shape of a toothpaste tube.

FIG. 2 shows a side view of an example charge holder 260 having an example envelope 280 in the form of an example cylinder 269 comprising an example top end cap 270 and an example bottom seal 273 similar to that seen in "toothpaste" type containers. The example top end cap 270 can either be formed from the sheet material 263 (e.g., foil, etc.) of the example cylinder 269, or can be independently first made and then glued or adhered to the example cylinder 269. In some examples, an injection type molded plastic top end cap 270 is adhered to the example cylinder 269 by melting into a sheet material 263 (e.g., foil, foil laminate, etc.). The example top end cap 270 is thus able to be easily manufactured from plastic. An example lip 271 and/or example mechanical connector 274 (e.g., threads) in the area of the example neck 262 can be used to seal the example charge holder 260 to an associated grenade body (not shown). In some examples, the example bottom seal 273 of the example charge holder 260 comprises a neck with a sealed end. Although not shown, it should be apparent that the bottom of the cylinder 269 can be made waterproof by bonding with adhesive. The bottom of the example cylinder 269 can alternatively be sealed in another manner, such as via a mechanical member (e.g., an bottom lid, a clamp, etc.). Prior to being bottom seal 273 being sealed the cylinder 269 inner walls can be coated with a low coefficient coating (268) or a secondary cylinder 290 of low coefficient material such as paper inserted prior to closing off bottom seal 273.

FIG. 3 shows a sectional cut-away view of a portion of an example charge holder 360 having an example neck 362 and an example envelope 380 in the shape of a cylinder 369. In some examples, the example envelope 380 is formed from an example sheet material 363 (e.g., a foil, etc.) forming, or facilitating the formation of, a closed form factor. In some examples, the example sheet material 363 could be wrapped around itself a plurality of times (e.g., 2*x*, 3*x*, etc.), depending on a thickness of the sheet material 363 and overall thickness constraint. In some examples, an example distal end 366 of the example sheet material 363 (e.g., a cylinder edge) is secured to an underlying layer of the example sheet material 363 via an adhesive (e.g., an integrated adhesive strip 367, an applied adhesive material, etc.). In some examples, the connection between the example distal end 366 and the underlying example sheet material 363 forms a waterproof seal.

In some examples, the envelope 380 cylinder 369 and bottom lid 366 construct can be made as a unitary piece, for example, by machining it from a sheet of metal where a slug of material is first made as a disc and then charge holder 360 is drawn from the disc. Alternatively, as an example of a two piece construct, envelope 380 is joined with a bottom lid 366 and either glued, welded or otherwise bonded to envelope 380, as indicated at 367. FIG. 3 shows an example two-piece construction.

The methods for adhesive and construction must however be sound enough that the charge holder is able to withstand enough pressure build up so that the pyrotechnic charge reaction takes place at an elevated pressure before the bottom lid 366 would break away from envelope 380 of the charge holder 360. A one piece construct is thus preferable as this eliminates the need for pressure testing. As previously described, the hoop stress (or otherwise wall stress in tension) should be to withstand stresses greater than 1000 psi. As previously described with respect to the example of FIG. 2, prior to adding pyrotechnic ingredients for in-situ mixing, if a low coefficient coating is not applied to the envelope 380 inner wall, a secondary cylinder 390 of low coefficient material such as paper can optionally be inserted. Note that for purposes of the MV value that if the neck 362 is sufficiently glued to a grenade end cap, such as that shown as end cap 104 of FIG. 1, this volume of material of the charge holder need not be included as MV in the CV/MV ratio.

The example of FIG. 3 shows an example bottom lid 366 sealing a bottom portion of the example envelope 380. In some examples, the example bottom lid 366 is made from a sheet material 363 (e.g., a foil, a foil laminate, etc.). In some examples, the example bottom lid 366 is mechanically and/or adhesively connected to the example envelope 380. For instance, an example bottom lid comprising a sheet material 363 may be pressed into or wrapped around a bottom portion of the example envelope, at an inner diameter or at an outer diameter, to form a bottom end to the example cylinder 369, thus forming the example envelope 380 into a closed cylinder form factor. In some examples, the example bottom lid 366 is sealed via an adhesive. Alternatively, the same example envelope 380 shape can be made by layering a sheet material 363 (e.g., foil, etc.), and then pressing and forming. As noted above, the sheet material 363 may include one layer (e.g., a foil) or a plurality of layers (e.g., a foil laminate, etc.), which could include one material or a plurality of different materials. In any of the aforementioned methods of construction of the example charge holder 360, the resulting charge holder 360 must be able to withstand a pressure build up sufficient to enable the pyrotechnic charge reaction to take place at an elevated pressure of about or greater than 14 psig relative to atmospheric pressure. As previously described, the hoop stress (or otherwise wall stress in tension) is advantageously configured to withstand stresses greater than 1000 psi.

Figure 4:
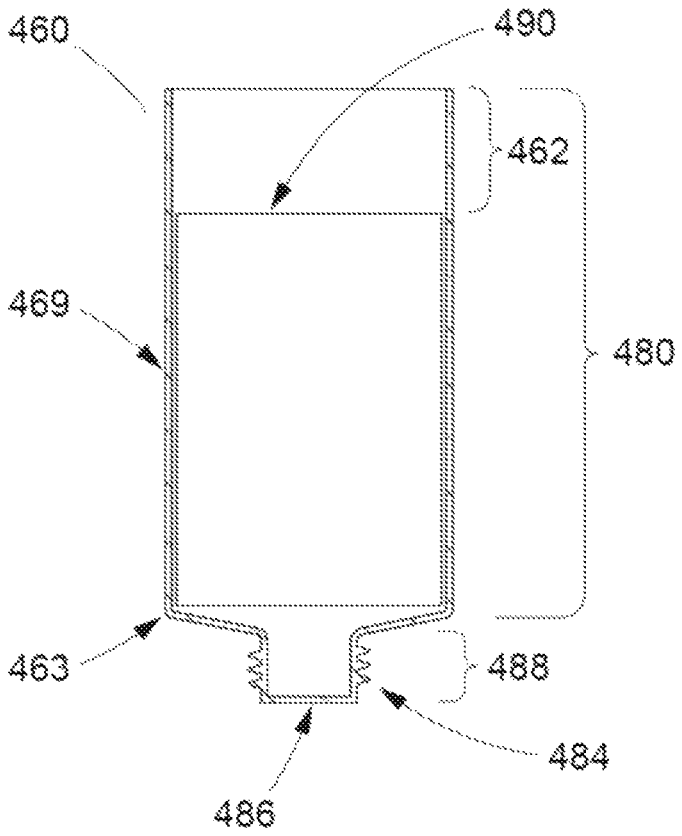
FIG. 4 is a side sectional view of third embodiment of a charge holder in accord with the present concepts.

FIG. 4 shows another example charger holder 460 in sectional view. In essence, this is a similar construct to that previously described in relation to FIG. 2, but the construct is "upside down" in order to better describe the means of attachment to a grenade body. Here, example neck 462 is used for filling with charge and then gluing to an associated grenade. The example neck 462 shares envelope's 480 wall of charge holder cylinder 469. The example sheet material 463 is shown as one layer. In other examples, the example sheet material 463 comprises a plurality of layers. FIG. 4 shows an example charge holder 460 comprising an example bottom neck 488 including example bottom threads 484. The example neck 462 includes an example bottom lid 486. FIG. 4 illustrates an example in which a bottom of the charge holder 460 is supported. Although not shown, the example neck 488 and example threads 484 can be used to support the charge holder 460 (or other embodiments shown in this disclosure) if fitted or attached to a receiver of an associated grenade. Thus, the example neck 488 can be configured to fit into an associated grenade body to help support the charge holder 460 during a drop test given that the envelope 480 (charge holder 460) is weak. This area is very unlikely to fragment, and could potentially block gas ports; however, being on the bottom, this can be easily diverted during explosion of the charge so as to not block grenade ports (see FIG. 1 at the bottom near 114 the conical area can be further recessed).

It is to be noted that, during explosion of the charge holder, neck 462 and bottom neck 488 are very unlikely to be involved in the discharge as it is bonded to the grenade top end cap and mounted to bottom end cap. Thus, this embodiment permits a lower MV since neither charge holder neck 462 nor bottom neck 488 is included in the MV. As indicted in the description for the example charge holders shown in FIGS. 2 and 3, here too, if in-situ mixing is desired and mixing time during manufacturing is needing to be reduced, the inner wall of envelope 480 can be coated with a low coefficient material or alternatively prior to adding pyrotechnic ingredients for in situ mixing, a secondary cylinder 490 of low coefficient material such as paper can be inserted.

Figure 5:
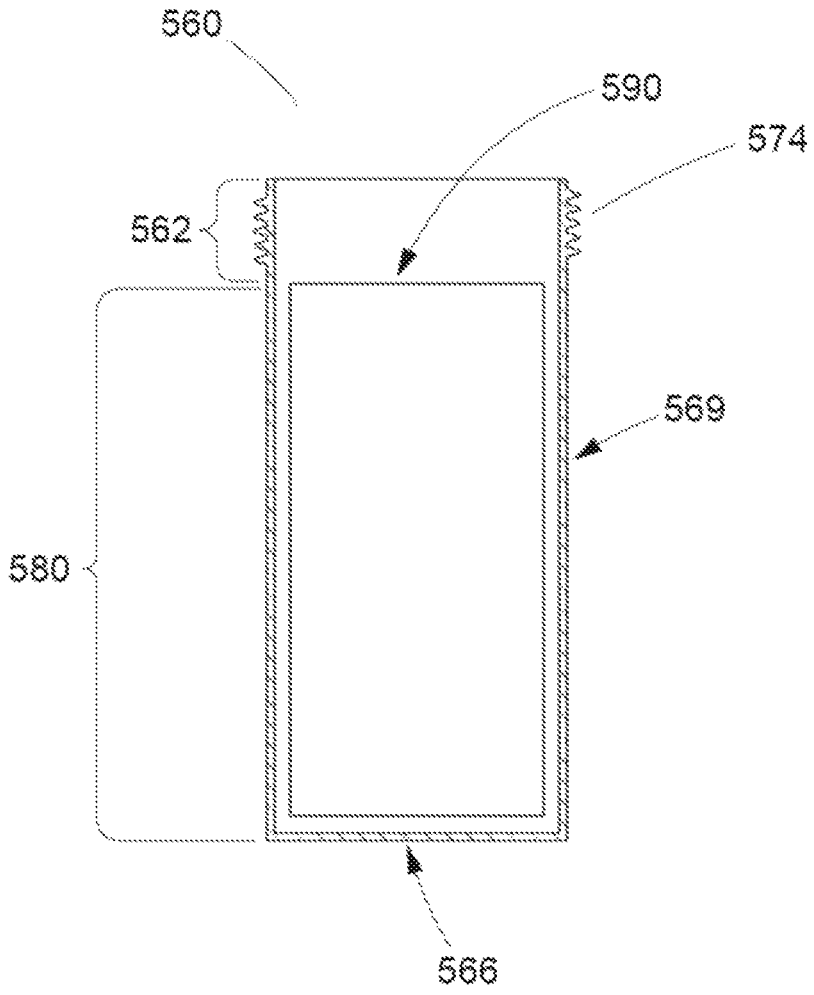
FIG. 5 is a side sectional view of a fourth embodiment of a charge holder in accord with the present concepts.

FIG. 5 shows a one piece charge holder 560 similar that shown in FIG. 3. Whereas FIG. 3 shows a two piece construct (charge holder 360 less endcap 366, FIG. 5 shows what was previously described in FIG. 3 as one solid piece which would be either machined from a solid billet of material, or made from a disc of material and stamped and drawn including forging or swaging threads 574 to a part of the charge holder 560 in the neck area 562. FIG. 5 shows portion of a charge holder 560 in sectional cut away view having neck 562 and envelope 580 in the shape of a cylinder 569 with a bottom lid 566. A one piece construct is preferable as previously indicated. A single piece construct as indicated eliminates the need for pressure testing. As previously described, the hoop stress (or otherwise wall stress in tension) should be able to withstand stresses greater than 1000 psi. As previously described in relation to FIG. 2, prior to adding pyrotechnic ingredients for in-situ mixing, if a low coefficient coating is not applied to the envelope 580 inner wall, a secondary cylinder 590 of low coefficient material such as paper can be inserted. Another advantage of this construct is that if a sheet of material is added to 580's inner wall, the sheet of material 590 can be more easily added to this construct than one with an internal endcap 366 as shown in FIG. 3. An endcap that is external to envelope 380 versus the internal endcap 366 shown in FIG. 3 would also resolve said issue, but an external endcap 366 would add more material volume. Note that, for purposes of the MV value, neck 562 and threads 574 material volumes are not included in the charge holder MV in the CV/MV ratio, provided the threads are substantial to withstand the forces on the bottom lid 566 during detonation. In addition, but not shown, but earlier described in for FIG. 4, there can be a bottom neck (like 488 having bottom threads 484) in addition to bottom lid 566 that would be identical in purpose as previously described to support the charge holder 560 for drop tests.

Figure 6:
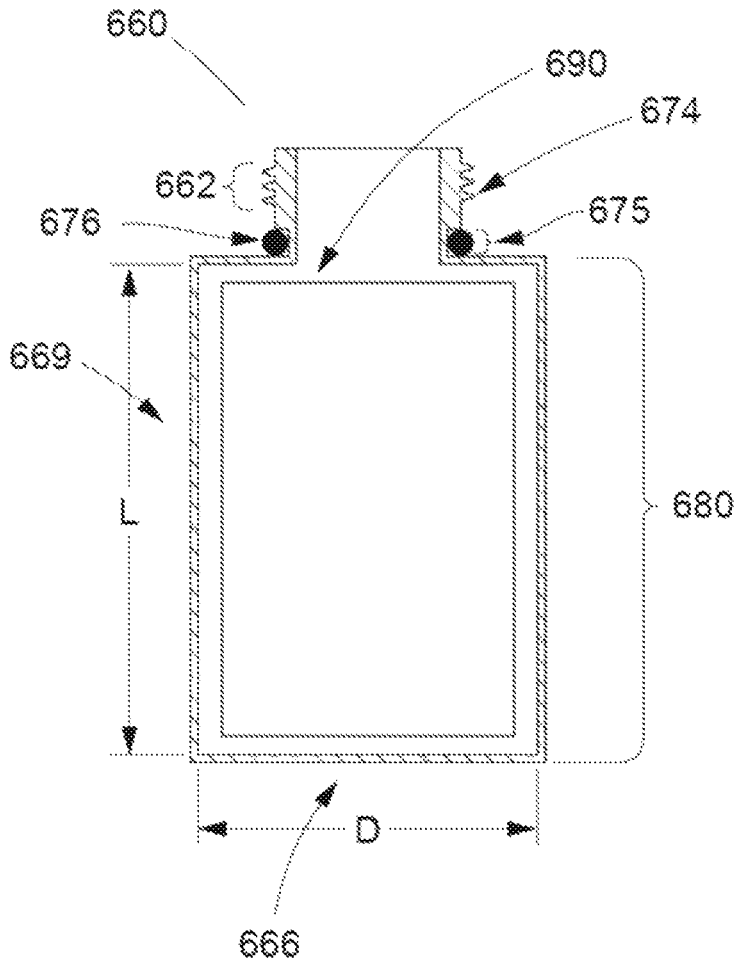
FIG. 6 is a side sectional view of a fifth embodiment of a charge holder in accord with the present concepts.

FIG. 6 shows a one piece charger 660 with all the features of FIG. 5 (i.e., charge holder envelope 680 in the shape of a cylinder 669 with a bottom lid 666), but with a slight change in geometry that forms a setback 675 between neck 662 having threads 674 and envelope 680 that permits an optional O-ring 676 (or flat seal etc.) that eliminates any need for thread sealant for a water tight charge holder connection to a grenade endcap such as that shown in FIG. 1 (where endcap 104 would be made with a mating thread for receiving threads 674). Another advantage of the charge holder 660 is that D, the diameter of envelope 680 is shown as being larger; and L, the envelope length (L) is shorter than that which is shown in FIG. 5 giving a smaller L/D ratio. This ratio has been determined not only to help promote better mixing of the pyrotechnic ingredients, but the lower L/D ratio has also been found to make it less likely that any additional support is needed for the charge holder 660 for passing drop tests. A ratio of L/D of around or less than 2.0 has been found to mix well enough that even though the coefficient of friction of the inner walls of envelope 680 may be higher than cardboard or plastic, if the charge holder is made from aluminum, no additional coating or sheet of material having a lower coefficient of static and dynamic friction is needed to lower the amount of time of mixing. In all the embodiments shown, it should be clear that no additional coating or sheet of material is required or needed, but is optional to promote better mixing and less time to mix pyrotechnic ingredients since premixed pyrotechnic ingredients can always be used in manufacturing a grenade. As an example, a single piece charge holder CNC machined from aluminum, and therefore having a turned inner surface having a high coefficient of friction, and having a wall thickness between 0.002" and 0.0275", with a length (L) of 1.527" and diameter (D) of 0.725" (i.e., an L/D of around 2.1), exhibits no need for additional coating or sheet of material when the CV/MV ratio is greater than 5.

The embodiments as described and shown in FIGS. 2-6 can be used to improve the performance of a flashbang grenade (e.g., the grenade in FIG. 1). The improvement in performance results from vent holes that are not blocked by a charge holder fragment as described herein. A further advantage is that expelled fragments of this charge holder do not carry enough energy to cause any damage to the surroundings from either momentum energy or from thermal energy. The use of example charge holders 160 through 560, as described herein, improves the safety of flash bang grenades as well as the performance.

A number of exemplary embodiments have been described herein. Obviously, modifications and alterations will occur to others upon reading and understanding the preceding detailed description. For instance, whereas examples herein describe an example charge holder comprising an envelope made from one or more layers of a sheet material to define an interior volume and an example neck comprising a connector (e.g., a threaded portion, a surface to receive an adhesive, a male connector, a female connector, etc.) to connect the envelope to a flashbang grenade body, another example charge holder in accord with aspects of the present concepts includes an envelope made from one or more layers of a sheet material to define an interior volume and an example recess (e.g., a female portion, an inverted neck, etc.) comprising a connector (e.g., a threaded portion, a surface to receive an adhesive, a male connector, a female connector, etc.) to connect the envelope to a flashbang grenade body. It is intended that the present disclosure be construed as including all such modifications and alterations insofar as they come within the scope of the appended claims or equivalents thereof. Some example configurations within the present concepts are delineated below.

In Example 1, a charge holder comprises an envelope made from a sheet material of foil formed from a metal or a metal alloy, the envelope defining an interior volume to receive therein a charge having a charge volume less than or equal to the interior volume, wherein a ratio of a charge volume of the interior volume to an envelope material volume is 5.0 or greater.

In Example 2, as to the charge holder of Example 1 and/or any one or more of Examples 3-11 set forth below, the envelope is configured to withstand a hoop stress level of greater than 1000 psi prior to failure.

In Example 3, as to the charge holder of any one or more of Examples 1-2 and/or any one or more of Examples 4-11 set forth below, the envelope is in the form of a cylinder.

In Example 4, as to the charge holder of any one or more of Examples 1-3 and/or any one or more of Examples 5-11 set forth below, a ratio L/D of the envelope length (L) to the envelope diameter is less than 2.1.

In Example 5, as to the charge holder of any one or more of Examples 1~4 and/or any one or more of Examples 6-11 set forth below, the charge holder further comprises a neck configured to connect the charge holder to a flashbang grenade body.

In Example 6, as to the charge holder of any one or more of Examples 1-5 and/or any one or more of Examples 7-11 set forth below, the neck comprises a mechanical connector to connect the charge holder to a mating mechanical connector on the flashbang grenade body.

In Example 7, as to the charge holder of any one or more of Examples 1-6 and/or any one or more of Examples 8-11 set forth below, the sheet material comprises an aluminum foil.

In Example 8, as to the charge holder of any one or more of Examples 1-7 and/or any one or more of Examples 9-11 set forth below, the sheet material has a thickness of between 0.0005" to 0.02".

In Example 9, as to the charge holder of any one or more of Examples 1-8 and/or Example 10 and/or Example 11 set forth below, the sheet material has a thickness of between 0.002" to 0.02".

In Example 10, as to the charge holder of any one or more of Examples 1-10 and/or Example 11 set forth below, the ratio of the charge volume of the interior volume to the envelope material volume is between 7.5-30.

In Example 11, as to the charge holder of any one or more of Examples 1-10, the charge holder further comprises a charge of a pyrotechnic material having a charge volume between 5.0 to 30 times the envelope material volume.

In Example 12 a flashbang grenade comprises a flashbang grenade body; an envelope made from a sheet material of foil formed from a metal or a metal alloy, the envelope defining an interior volume to receive therein a charge having a charge volume less than or equal to the interior volume; and a charge of a pyrotechnic material having a charge volume less than or equal to the interior volume, wherein a ratio of the charge volume to an envelope material volume is 5.0 or greater.

In Example 13, as to the flashbang grenade of Example 12 and/or any one or more of Examples 14-20 set forth below, the envelope defines a charge volume to envelope material volume ratio of between 5.0-30.

In Example 14, as to the flashbang grenade of any one or more of Examples 12-13 and/or any one or more of Examples 15-20 set forth below, the envelope is configured to withstand a hoop stress level greater than about 1000 psi at a temperature less than 1300° F.

In Example 15, as to the flashbang grenade of any one or more of Examples 12-14 and/or any one or more of Examples 16-20 set forth below, the envelope is configured to withstand a hoop stress level greater than about 1000 psi at a temperature less than about 1300° F.

In Example 16, as to the flashbang grenade of any one or more of Examples 12-15 and/or any one or more of Examples 17-20 set forth below, the envelope is in the form of a cylinder.

In Example 17, as to the flashbang grenade of any one or more of Examples 12-16 and/or any one or more of Examples 18-20 set forth below, a ratio L/D of the envelope length (L) to the envelope diameter is less than 2.1.

In Example 18, as to the flashbang grenade of any one or more of Examples 12-17 and/or any one or more of Examples 19-20 set forth below, the charge holder further comprises a neck configured to connect the charge holder to the flashbang grenade body and, optionally, the neck comprises a mechanical connector to connect the charge holder to a mating mechanical connector on the flashbang grenade body.

In Example 19, as to the flashbang grenade of any one or more of Examples 12-18 and/or Example 20 set forth below, wherein the sheet material comprises an aluminum foil.

In Example 20, as to the flashbang grenade of any one or more of Examples 12-19 above, the sheet material has a thickness of between 0.0005" to 0.02".

What is claimed is:

1. A flexible charge holder comprising:

a flexible envelope made from a flexible sheet material of foil formed from a metal or a metal alloy, the flexible envelope defining an interior volume to receive and retain therein a charge having a charge volume less than or equal to the interior volume, wherein a ratio of a charge volume of the interior volume to an envelope material volume is 5.0 or greater, wherein the flexible envelope comprises a first end portion, a flexible sidewall, and a second end portion, wherein the first end portion of the flexible envelope comprises an opening to receive a charge volume of a pyrotechnic material, wherein the second end portion of the flexible envelope is closed, and wherein the flexible sidewall extends between the first end portion and the second end portion.

2. The flexible charge holder of claim 1, wherein the flexible envelope is configured to withstand a hoop stress level of greater than 1000 psi prior to failure.

3. The flexible charge holder of claim 1, wherein the sidewall of the flexible envelope is in the form of a cylinder.

4. The flexible charge holder of claim 3, wherein a ratio L/D of the flexible envelope length (L) to the flexible envelope diameter (D) is less than 2.1.

5. The flexible charge holder of claim 1, wherein the first end of the flexible charge holder further comprises a neck configured to connect the flexible charge holder to a flashbang grenade body.

6. The flexible charge holder of claim 1, wherein the neck comprises a mechanical connector to connect the flexible charge holder to a mating mechanical connector on the of a flashbang grenade body.

7. The flexible charge holder of claim 1, wherein the flexible sheet material comprises an aluminum foil.

8. The flexible charge holder of claim 1, wherein the flexible sheet material has a thickness of between 0.0005" to 0.02".

9. The flexible charge holder of claim 1, wherein the flexible sheet material has a thickness of between 0.002" to 0.02".

10. The flexible charge holder of claim 1, wherein the ratio of the charge volume of the interior volume to the envelope material volume is between 7.5-30.

11. The flexible charge holder of claim 1, further comprising:

a charge of a pyrotechnic material having a charge volume between 5.0 to 30 times the envelope material volume.

12. A flashbang grenade comprising:

a flashbang grenade body;

a flexible envelope made from a flexible sheet material of foil formed from a metal or a metal alloy, the flexible envelope defining an interior volume to receive and retain therein a charge having a charge volume less than or equal to the interior volume, the flexible envelope comprising a first end portion, a flexible sidewall, and a second end portion, the first end portion of the flexible envelope comprising an opening to receive a charge volume of a pyrotechnic material, the second end portion of the flexible envelope being closed, with the flexible sidewall extending between the first end portion and the second end portion; and a charge of a pyrotechnic material having a charge volume less than or equal to the interior volume, wherein a ratio of the charge volume to an envelope material volume is 5.0 or greater.

13. The flashbang grenade of claim 12, wherein the flexible envelope defines a charge volume to envelope material volume ratio (CV/MV) of between 5.0-30.

14. The flashbang grenade of claim 13, wherein the flexible envelope is configured to withstand a hoop stress level greater than about 1000 psi at a temperature less than 1300° F.

15. The flashbang grenade of claim 12, wherein the flexible envelope is configured to withstand a hoop stress level greater than about 1000 psi at a temperature less than 1300° F.

16. The flashbang grenade of claim 12, wherein the flexible sidewall of the envelope is in the form of a cylinder.

17. The flashbang grenade of claim 12, wherein a ratio L/D of the envelope length (L) to the envelope diameter (D) is less than 2.1.

18. The flashbang grenade of claim 12, wherein the first end portion of the charge holder further comprises a neck configured to connect the charge holder to the flashbang grenade body and, optionally, wherein the neck comprises a mechanical connector to connect the charge holder to a mating mechanical connector on the flashbang grenade body.

19. The flashbang grenade of claim 12, wherein the flexible sheet material comprises an aluminum foil.

20. The flashbang grenade of claim 12, wherein the flexible sheet material has a thickness of between 0.0005" to 0.02".

* * * * *